US005100161A

United States Patent [19]

Tillyer

[11] Patent Number: 5,100,161

[45] Date of Patent: Mar. 31, 1992

[54] SKATEBOARD FOR USE IN OFF-ROAD SITUATIONS

[76] Inventor: Joseph Tillyer, 20 Dacotah Ave., Rockaway, N.J. 07866

[21] Appl. No.: 668,221

[22] Filed: Mar. 12, 1991

[51] Int. Cl.[5] ..... A63C 17/02

[52] U.S. Cl. ..... 280/87.042; 280/7.1; 301/5.3; 301/40 S; 301/111

[58] Field of Search ..... 280/87.042, 7.1, 11.28, 280/11.19; 301/513, 5.7, 5 R, 111, 114, 130, 40 S; 152/11, 12, 7, 5

[56] References Cited

U.S. PATENT DOCUMENTS 4,645,223 2/1987 Grossman ..... 280/87.042
4,666,216 5/1987 Smith ..... 301/40 S

FOREIGN PATENT DOCUMENTS 2721950 4/1978 Fed. Rep. of Germany ..... 280/87.042.

OTHER PUBLICATIONS

Go For It, Sports. Advertisement in Skate-Boarder Magazine, Dec. 1977, vol. 4, No. 5.
Cell Blocks, Advertisement in Skate Boarder Magazine, Mar. 1978, vol. 4, No. 8, p. 8.

*Primary Examiner*—David M. Mitchell
*Attorney, Agent, or Firm*—Terry M. Gernstein

[57] ABSTRACT

A skateboard is modified for use on off-road terrain and includes a shock absorber system. The shock absorber system includes a spacer unit having a plurality of shock absorber plates affixed to the deck unit of the skateboard and to which the skateboard axle is pivotally fixed. Shock absorber wheels are fastened to the skateboard wheels by self-tapping screws extending through a central hub section of the shock absorber wheels and into the skateboard tires. Shock absorber material, such as foam material or a helical spring, is located inside the tires of the shock absorber wheels.

7 Claims, 4 Drawing Sheets

SKATEBOARD FOR USE IN OFF-ROAD SITUATIONS

TECHNICAL FIELD OF THE INVENTION

The present invention relates to the general art of land vehicles, and to the particular field of skateboards.

BACKGROUND OF THE INVENTION

The sport of skateboarding has become extremely popular with people of all ages, but especially with young people. As is indicated in FIG. 1, a skateboard S includes a deck unit D having a nose section N and a tail section T, and which is supported by two wheel units WU. Each wheel unit includes a riser pad RP connected to the deck unit and having wheels W attached to a trunk unit TU by bearings B. The skateboard is ridden by standing on the deck unit as the skateboard rolls over a surface.

Skateboards, such as skateboard S, are extremely popular; however, they do have several drawbacks that may inhibit the further growth of the sport of skateboarding. For example, while the skateboard S works well on even terrain, such as is found on roadways, sidewalks and the like, it may encounter difficulties in traversing uneven terrain such as might be found in off-road locations. Hills, gullies and the like may create problems for the skateboard S.

While the art has includes skateboards that can be converted from a typical dry land vehicle to a snow or ice sliding vehicle, such skateboards are still not entirely suitable for use in rough terrain. Other skateboards have special tank-like tracks in place of the wheels W to improve the stability of the skateboard. However, such runners do not rotate as freely as a wheel and thus may reduce the overall enjoyment of the skateboard. Still other skateboards have wheel assemblies that can be adjusted to accommodate different riders, however these adjusting features cannot account for the obstacles that may be encountered in an off-road situation.

Accordingly, there is a need for a skateboard that can be used in an off-road situation.

However, since many skateboard riders do not wish to purchase a new, special, off-road skateboard, there is a further need for a kit that can be used to modify or adapt a skateboard, such as skateboard S, to a vehicle that can be used in off-road situations.

OBJECTS OF THE INVENTION

It is a main object of the present invention is to provide a skateboard that can be used in an off-road situation.

It is another object of the present invention to provide a kit that can be used to adapt a skateboard to an be an off-road vehicle.

SUMMARY OF THE INVENTION

These, and other, objects are achieved by a skateboard that is adapted for use off road, that is in uneven terrain. The skateboard includes wheel units that are spaced from the skateboard deck unit by shock-absorber means. The wheel units are easily attached to the wheels that are already extant on the skateboard, and a further spacer unit can be included to further space the wheels from the deck unit.

A skateboard is thus easily adapted for use off road, and will be able to accommodate the uneven terrain encountered in such off-road situations.

BRIEF DESCRIPTION OF THE DRAWING FIGURES

DETAILED DESCRIPTION OF THE PREFERRED EMBODIMENT OF THE INVENTION

Figure 1:
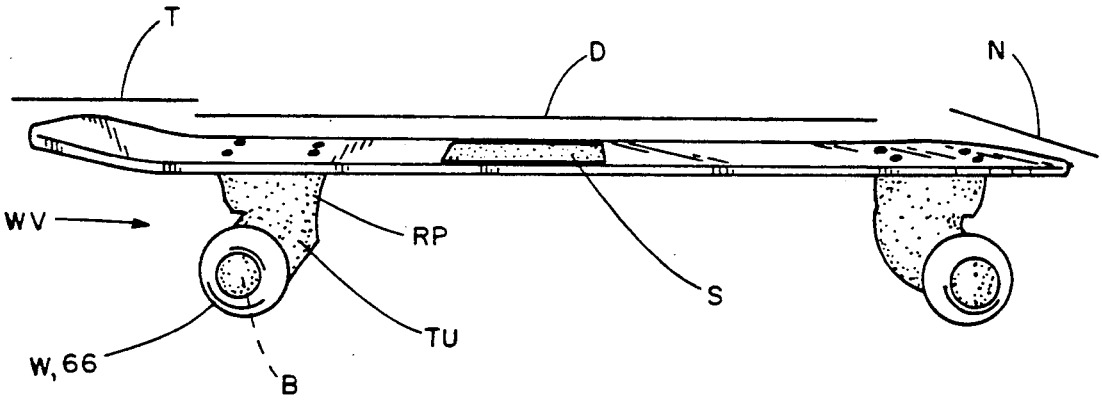
FIG. 1 (PRIOR ART)
FIG. 1 is a side elevational view of a prior art skateboard.
Figure 2:
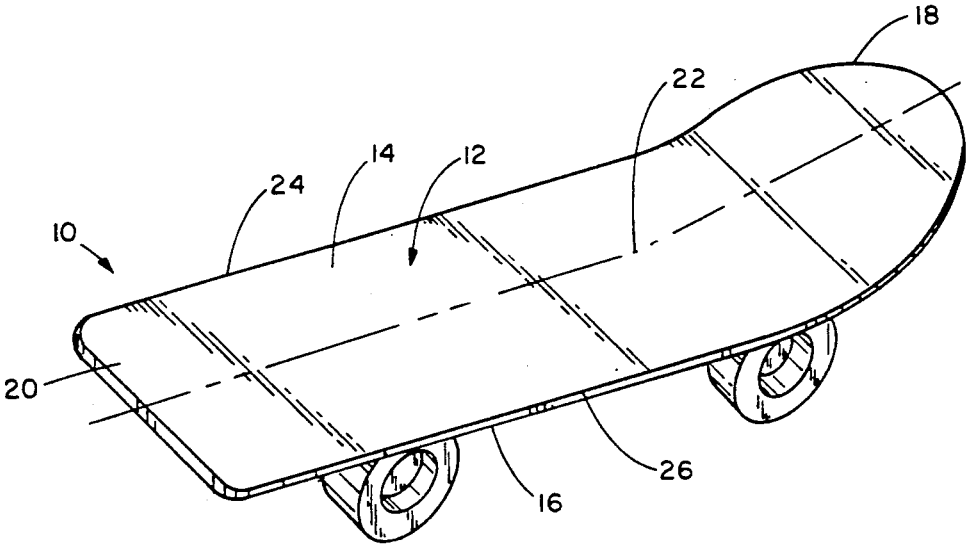
FIG. 2 is a top perspective view of a skateboard that has been adapted for off-road use in accordance with the present invention.

Shown in FIG. 2 is a skateboard 10 embodying the present invention. The skateboard 10 is adapted for use in off-road conditions that may include rough and uneven terrain. The skateboard 10 includes shock absorbing means that produces a smooth and controllable ride even in such off-road terrain, and can be formed by modifying a skateboard, such as skateboard S.

The skateboard 10 includes a deck unit 12 having a top surface 14 on which a rider is supported, a bottom surface 16 that is presented toward the terrain, a nose end 18, and a tail end 20 that are separated from each other along a longitudinal axis 22 of the skateboard. Sides 24 and 26 connect the nose end to the tail end of the skateboard. Footplates 27 are also located on the skateboard deck unit.

Figure 3:
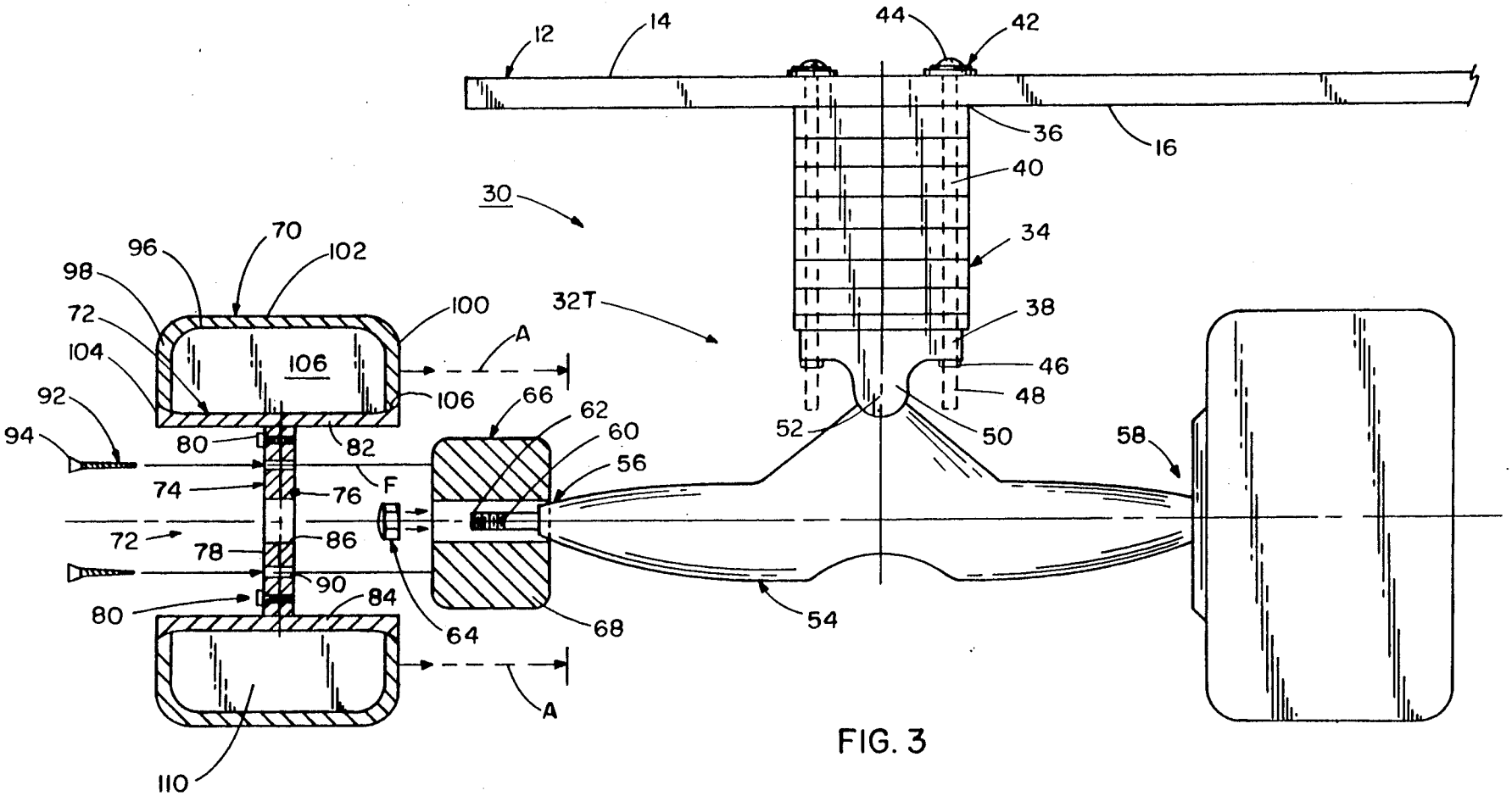
FIG. 3 is an end elevational view of the off-road skateboard of the present invention.
Figure 4:
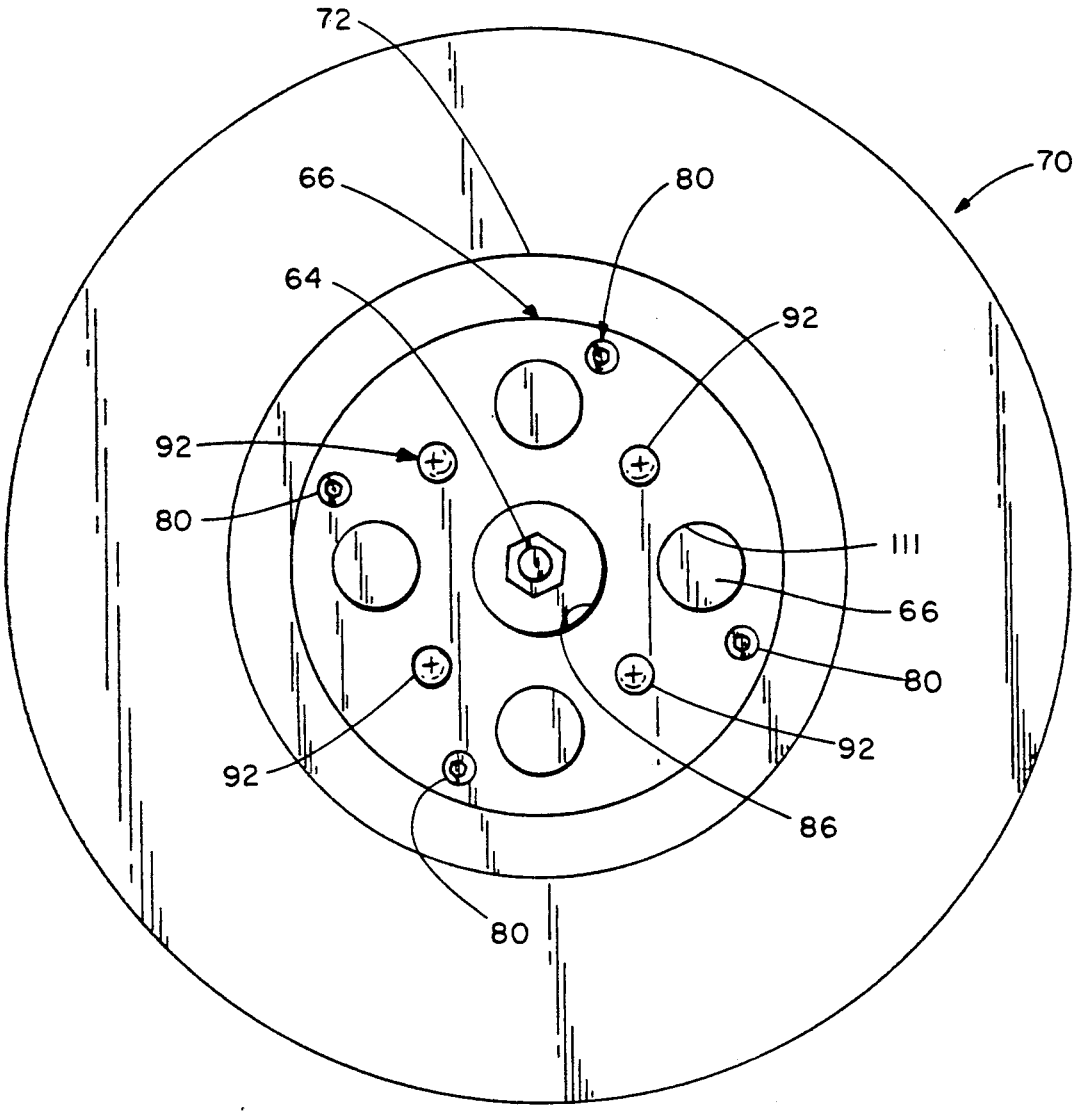
FIG. 4 is an elevational view of a shock absorbing wheel that is fixed to an existing wheel of a skateboard.
Figure 5:
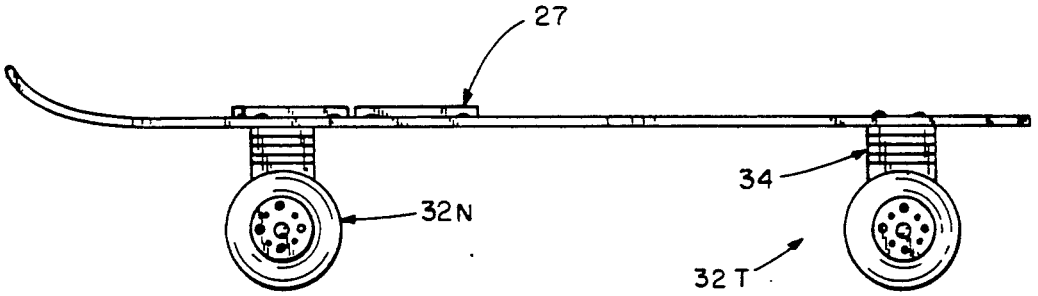
FIG. 5 is a side elevational view of the off-road skateboard of the present invention.

As is best shown in FIGS. 3, 4 and 5, the skateboard 10 includes a shock absorber means 30 that serves to permit the skateboard to be used in rough terrain. The shock absorber means 30 includes a two identical shock absorber support units 32N and 32T, located near the nose end 18 and the tail end 20, respectively. Since these shock absorber units are identical, only one such unit will be discussed. As best shown in FIG. 3, support unit 32T includes a first spacer unit 34 attached at a top end 36 to the deck bottom surface 16 and includes a special axle mounting element 38 on a lower end thereof. The spacer unit 34 includes a plurality of separate plates, such as plate 40, that can be formed of plastic or the like, or can be spring-like material that will absorb shocks directed longitudinally of the unit 34. Each plate, along with the axle mounting element, includes fastener-receiving holes defined therethrough, and a plurality of fasteners, such as bolt 42 having a head 44 in abutting engagement with the deck top surface 14 and an internally threaded nut 46 on an externally threaded end 48 thereof, attach the unit 34 to the deck unit 12

The axle mounting element 38 includes a nose section 50 that depends below the spacer unit and has a pivot pin 52 mounted thereon. A skateboard axle 54 extends transversely of the skateboard, and is pivotally connected to the axle mounting element 38 by the pivot pin 52. The axle 54 includes two ends 56 and 58, each having an externally threaded fastener, such as fastener 60, thereon. A wheel bearing 62 is attached to the axle, and a nut 64 is threadably attached to the fastener 60. A skateboard wheel 66 is rotatably attached to the axle, and includes a tire section 68 that rides over a surface.

The shock absorbing spacer means further includes a shock absorber wheel 70 fixed to each wheel 66. Each shock absorber wheel includes a bipartite central hub 72 having two U-shaped sections 74 and 76 that are fixed together at bight sections, such as bight section 78 of section 74, by fasteners, such as bolt 80. Each U-shaped section further include two short legs, such as legs 82 and 84 of section 76 connected to the bight section. The central hub thus includes two annular elements in back-to-back relationship. A central cutout 86 is defined through the hub to accommodate the nut 64, and a plurality of fastener-receiving holes 90 have self-tapping fasteners 92 received therethrough. The fasteners 92 have heads 94 that engage the central hub section adjacent to the holes 90 and screw into the tire 68 of the wheel 66 to attach the wheel 70 to the wheel 66 as is indicated in FIG. 3 by arrows F. The central hub section has an inner diameter that is slightly greater than the outer diameter of the wheel 66 whereby the wheel 70 can fit around the wheel 66 in surrounding relationship thereto as is indicated in FIG. 3 by arrows A.

The wheel 70 further includes a U-shaped tire section 96 having two short legs 98 and 100 connected together by a bight section 102 and attached at ends 104 and 106 respectively to the central hub section. The tire section bight section is spaced radially outward from the central hub section to define a closed chamber 106 surrounding the central hub section. A shock absorbing means 110, such as foam rubber, is located in the chamber 106. Shocks to the tire 70 are thus absorbed by the wheels 70, the shock absorber means, the wheels 66, the axle 54 and the spacer unit 34. All of these elements co-operate to prevent severe shocks to the wheels 70 from reaching the skateboard deck 12 and thereby either damaging that deck unit or being transmitted to a skateboard rider. A plurality of circular cutouts 111 are also defined through the central hub section. The tire 66 is visible through these cutouts 111 as indicated in FIG. 4.

Figure 8:
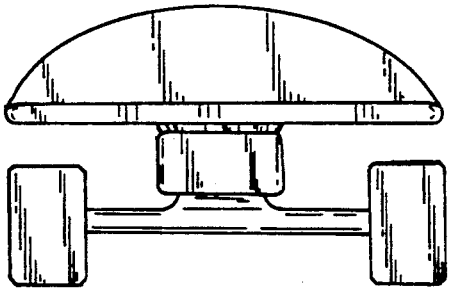
FIG. 8 is an end elevational view of an off-road skateboard with the FIG. 7 spacer unit installed thereon.
Figure 9:
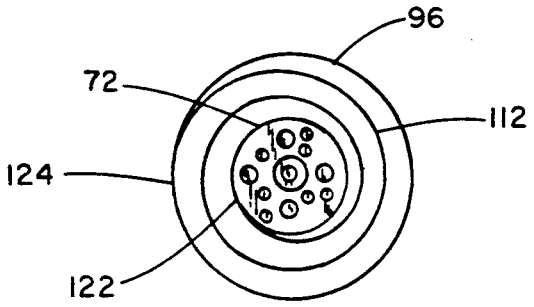
FIG. 9 is an elevational view of an alternative form of shock absorber wheel that includes a helical spring located between the existing skateboard wheel and the rim of the shock absorber.
Figure 6:
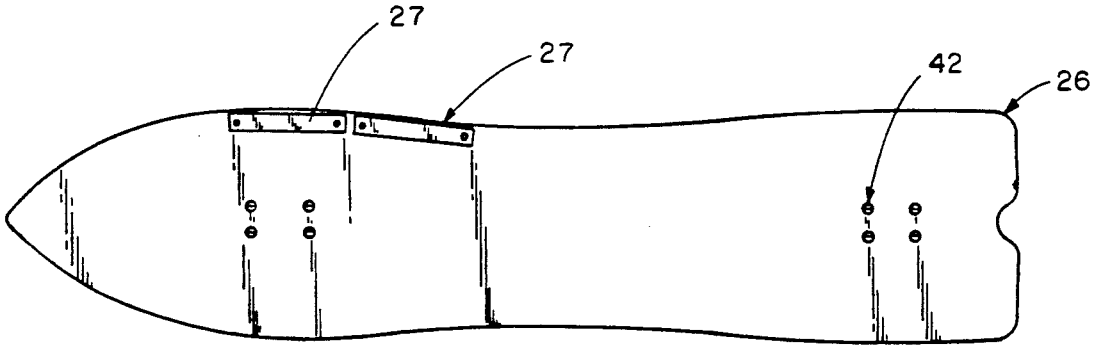
FIG. 6 is a top plan view thereof.
Figure 7:
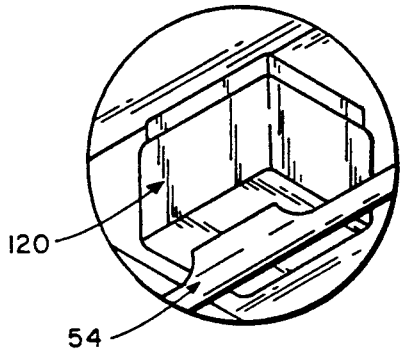
FIG. 7 is a perspective view of an alternative form of spacer unit used in the off-road skateboard of the present invention.

The spacer unit 34 can be encased in a housing 120 as is indicated in FIGS. 7 and 8, and the shock absorbing means 110 can include a helical spring 112 such as shown in FIG. 9 as having one end 122 thereof attached to the central hub 72 and another end 124 thereof attached to the tire 96.

It is understood that while certain forms of the present invention have been illustrated and described herein, it is not to be limited to the specific forms or arrangements of parts described and shown.

What is claimed is:

1. An off-road skateboard for use on rough terrain comprising:

A) a deck unit having an upper surface, a bottom surface, a nose end, a tail end, sides connecting said nose end to said tail end, and a longitudinal axis extending between said nose end and said tail end;

B) a first shock absorbing means located adjacent to said nose end and a second shock absorbing means located adjacent to said tail end, each shock absorbing means including (1) a shock absorbing spacer unit affixed at a top end thereof to said deck unit bottom surface and having a bottom end spaced from said deck unit bottom surface, said spacer unit including a plurality of shock absorbing plates, (2) fastener means attaching said spacer unit to said deck unit, (3) an axle mounting element on said spacer unit bottom end, (4) a pivot pin fixed to said axle mounting element, (5) a wheel axle attached to said pivot pin and extending transversely of said deck unit and including two ends, (6) a skateboard wheel rotatably attached to each end of said axle, each skateboard wheel including a tire section, said skateboard wheels each having an outer diameter, (7) a shock absorber wheel mounted on each skateboard wheel and including (a) a central hub section formed of two annular U-shaped elements each having two short legs and a bight section connecting said central hub section short legs together, said central hub section short legs being spaced apart by a distance greater than said skateboard wheel outer diameter and said bight sections being in back-to-back abutting relationship with each other, said central hub section having a plurality of fastener receiving holes defined therethrough, (b) a plurality of self-tapping fasteners extending through said central hub section fastener-receiving holes, each self-tapping fastener including a head that abuttingly engages said central hub section adjacent to said fastener-receiving holes and a threaded body that threads into said skateboard tire section to attach said shock absorber wheel to said skateboard wheel, (c) each central hub section having an outer diameter, (d) a shock absorber wheel U-shaped tire section having two short legs each of which is attached to said central hub section and each of which extends radially outwardly of said central hub section and a bight section connecting said shock absorber wheel tire section short legs together, said shock absorber wheel tire section bight section being spaced radially outward of said central hub section to define a chamber within said shock absorber wheel tire section and around said central hub section, and (e) a shock absorber means located in said chamber.

2. The off-road skateboard defined in claim 1 wherein said shock absorber wheel shock absorber means includes foam material.

3. The off-road skateboard defined in claim 1 wherein said shock absorber wheel shock absorber means includes a helical spring.

4. The off-road skateboard defined in claim 1 further including a housing encasing said spacer unit.

5. The off-road skateboard defined in claim 1 further including threaded fastener means attaching said spacer unit to said deck unit.

6. The off-road skateboard defined in claim 5 further including cutouts defined through said central hub section.

7. In a skateboard of the type having a deck unit having an upper surface, a bottom surface, a nose end, a tail end, sides connecting said nose end to said tail end, and a longitudinal axis extending between said nose end and said tail end, the improvement in combination therewith comprising:

a kit for modifying the skateboard for use in off-road situations, said kit including a first shock absorbing means located adjacent to said nose end and a second shock absorbing means located adjacent to said tail end, each shock absorbing means including (1) a shock absorbing spacer unit affixed at a top end thereof to said deck unit bottom surface and having a bottom end spaced from said deck unit bottom surface, said spacer unit including a plurality of shock absorbing plates, (2) fastener means attaching said spacer unit to said deck unit, (3) an axle mounting element on said spacer unit bottom end, (4) a pivot pin fixed to said axle mounting element, (5) a wheel axle attached to said pivot pin and extending transversely of said deck unit and including two ends, (6) a skateboard wheel rotatably attached to each end of said axle, each skateboard wheel including a tire section, said skateboard wheels each having an outer diameter, (7) a shock absorber wheel mounted on each skateboard wheel and including (a) a central hub section formed of two annular U-shaped elements each having two short legs and a bight section connecting said central hub section short legs together, said central hub section short legs being spaced apart by a distance greater than said skateboard wheel outer diameter, said bight sections being in back-to-back relationship with each other, said central hub section having a plurality of fastener receiving holes defined therethrough, (b) a plurality of self-tapping fasteners extending through said central hub section fastener-receiving holes, each self-tapping fastener including a head that abuttingly engages said central hub section adjacent to said fastener-receiving holes and a threaded body that threads into said skateboard tire section to attach said shock absorber wheel to said skateboard wheel, (c) each central hub section having an outer diameter, (d) a shock absorber wheel U-shaped tire section having two short legs each of which is attached to said central hub section and each of which extends radially outwardly of said central hub section and a bight section connecting said shock absorber wheel tire section short legs together, said shock absorber wheel tire section bight section being spaced radially outward of said central hub section to define a chamber within said shock absorber wheel tire section and around said central hub section, and (e) a shock absorber means located in said chamber.

* * * * *